US005121031A

United States Patent [19]

Nishihara

[11] Patent Number: 5,121,031

[45] Date of Patent: Jun. 9, 1992

[54] MICROWAVE ELECTRON GUN

[75] Inventor: Susumu Nishihara, Amagasaki, Japan

[73] Assignee: Mitsubishi Denki Kabushiki Kaisha, Tokyo, Japan

[21] Appl. No.: 690,569

[22] Filed: Apr. 24, 1991

Related U.S. Application Data

[62] Division of Ser. No. 385,149, Jul. 26, 1989.

[30] Foreign Application Priority Data

Aug. 4, 1988 [JP] Japan ..... 63-193400

[51] Int. Cl.[5] ..... H01J 23/06; H01J 23/15

[52] U.S. Cl. ..... 315/5.41; 315/5.39; 328/227

[58] Field of Search ..... 315/5.39, 3.5, 5.32, 315/5.41, 111.81; 313/359.1, 446, 356; 328/227

[56] References Cited

U.S. PATENT DOCUMENTS

| | | | |
|---|---|---|---|
| 3,558,967 | 1/1971 | Miriam | 315/5.39 X |
| 4,286,192 | 8/1981 | Tanabe et al. | 315/5.41 |
| 4,629,938 | 12/1986 | Whitham | 315/5.41 |
| 4,746,839 | 5/1988 | Kazusa et al. | 315/5.41 |
| 4,988,919 | 1/1991 | Tanabe et al. | 315/5.41 |

*Primary Examiner*—Eugene R. LaRoche
*Assistant Examiner*—Do Hyum Yoo

[57] ABSTRACT

A microwave electron gun for a linear accelerator uses microwave energy to impart an initial acceleration to electrons emitted from a lanthanum-hexaboride cathode. The microwaves are contained in an electron-gun cavity, the upstream wall of which has a protruding part surrounding the entrance opening that accommodates the cathode, and the downstream wall of which has a flat part surrounding an exit opening. The rest of the downstream wall has a radius of curvature equal to that of the other microwave cavities in the accelerating tube, and its center of curvature is aligned with theirs. The cathode is fused to a pair of carbon electrodes to form a cathode block, which is held by clamping between a pair of electrode bars, thus forming a cathode tube. The cathode tube is inserted into a sleeve upstream of the entrance opening in the electron-gun cavity, and is surrounded at a distance of one quarter-wavelength from the cathode by a disk-shaped choke cavity extending one quarter-wavelength from the cathode tube. This electron gun is easy design and operate, and prevents loss of microwave energy.

11 Claims, 3 Drawing Sheets

MICROWAVE ELECTRON GUN

This application is a divisional of copending application Ser. No. 07/385,149, filed on Jul. 26, 1989. The entire contents of which are hereby incorporated by reference.

BACKGROUND OF THE INVENTION

1. Field of the Invention

This invention relates to a microwave electron gun for use in a linear accelerator.

Linear accelerators that generate electron beams are employed not only in scientific research but also in medical and industrial fields, their applications including, for example, non-destructive testing and electron-beam lithography. Many of these linear accelerators use microwave energy: the electrons are emitted from an electron gun and accelerated to high velocities as they travel down an accelerating tube comprising a series of cavities containing microwave electric fields.

2. Description of the Background Art

The electron guns commonly employed in linear accelerators in the past comprise an anode which is held at ground potential, a cathode which is raised to a high negative potential, a heating filament disposed just behind the cathode, and a Wehnelt electrode surrounding the cathode. Heating of the cathode by the filament produces thermionic emission of electrons, which are accelerated toward the anode by the strong dc electric field that exists between the cathode and anode. The Wehnelt electrode focuses the electrons into a beam which passes through a hole in the anode and enters the accelerating cavity. The beam emittance depends on the intensity distribution of the electric field, and the properties of the beam can be controlled by altering the shape of the Wehnelt electrode.

One problem with the prior-art electron gun described above concerns the coupling between the electron gun and the accelerating tube. Microwave radiation tends to escape from the accelerating tube into the electron gun via this coupling, causing a loss of microwave energy, hence a reduction in the amount of energy available for accelerating the electrons.

Another problem is the complex structure of the Wehnelt electrode, which complicates the design of the electron gun. The complexity is a consequence of the high dc voltage that must be applied across the cathode and anode in order to direct the electrons into the accelerating tube.

A third problem is accurate positioning of the electron gun. This problem occurs because the electron gun is mounted separately from the accelerating tube.

An alternative type of electron gun employs microwave energy instead of a dc field to impart an initial acceleration to the electrons. The initial acceleration takes place in an electron-gun cavity disposed just in front of the cathode.

The development of such a microwave electron gun for use in a linear accelerator at Stanford University has been described in a paper by G. A. Westenkow and J. M. J. Madey in volume 2, part 2, pages 223 to 225 of *Lasers and Particle Beams*, published in 1984. With such a microwave electron gun, however, it is still necessary to solve the mounting problem described above, the problem of the loss of microwave energy, and other problems such as the shape of the electron-gun cavity and its linkage to the other cavities of the accelerating tube. The present invention is addressed to these problems.

SUMMARY OF THE INVENTION

One object of this invention is to prevent the loss of microwave energy in the electron gun of a linear accelerator.

Another object of the invention is to use microwave energy to impart an initial acceleration to the electrons emitted from a cathode and to shape them into a beam.

Still another object of the invention is to adjust the level of microwave power by varying simple design parameters.

Yet another object of the invention is to enable the cathode to be mounted conveniently and positioned accurately.

A microwave electron gun according to an embodiment of this invention provides an electron beam that is accelerated by a microwave electric field in an accelerating tube having a series of cavities, and comprises an electron-gun cavity, the upstream wall of which has a protruding part surrounding an entrance opening and the downstream wall of which has a flat part surrounding an exit opening. The rest of the downstream wall has a radius of curvature equal to that of the other microwave cavities in the accelerating tube, and its center of curvature is aligned with theirs. Extending upstream from the entrance opening is a sleeve in which a cathode tube is inserted. The cathode tube comprises a pair of electrode bars, at one end of which a cathode block is held by clamping. The cathode block comprises a lanthanum-hexaboride cathode, to which is fused to a pair of carbon electrodes that contact the electrode bars. The sleeve is surrounded at a distance of one quarter-wavelength from the cathode by a disk-shaped choke cavity extending one quarter-wavelength from the cathode tube.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE EMBODIMENTS

A novel microwave electron gun embodying the present invention will be described with reference to the drawings. For clarity, the drawings illustrate three aspects of the invention separately: a first aspect concerned with the prevention of microwave energy loss; a second aspect concerned with the design of an electron-gun cavity for acceleration of electrons emitted from the cathode; and a third aspect concerned with the mounting of the cathode.

Figure 1:
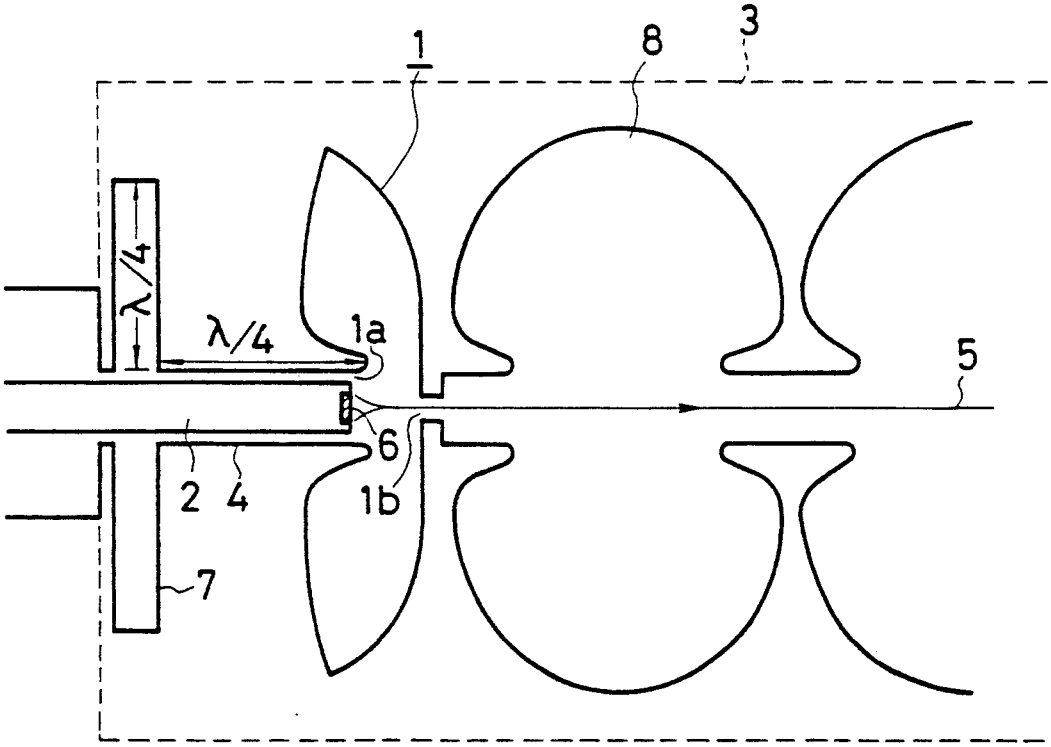
FIG. 1 is a sectional drawing illustrating a choke cavity structure of an embodiment of the present invention.

FIG. 1 is a sectional view illustrating the overall structure of a novel microwave electron gun showing a first aspect of the invention. The novel microwave electron gun comprises an electron-gun cavity 1, the detailed structure and function of which will be explained in the description of the second aspect of the invention, and a cathode tube 2, the detailed structure and function of which will be explained in the description of the third aspect of the invention. The electron-gun cavity 1 and cathode tube 2 are disposed near the upstream end of an accelerating tube 3. The electron-gun cavity 1 has an exit opening 1*b* on its downstream side, for the passage of an electron beam 5 into downstream cavities in the accelerating tube 3, and an entrance opening 1*a* on its upstream side, which opens into a sleeve 4 of the accelerating tube 3. The cathode tube 2 is disposed in the sleeve 4, with a slight gap between the cathode tube 2 and the wall of the sleeve 4. The function of the cathode tube is to support a cathode 6 for the emission of electrons. The cathode 6 is disposed at the end of the cathode tube 2 near the entrance opening 1*a* in the electron-gun cavity 1, facing toward the exit opening 1*b*.

Although not shown in this drawing, means are provided for introducing microwave radiation into the electron-gun cavity 1 and the other downstream cavities, such as an accelerating cavity 8, of the accelerating tube 3. This microwave radiation acts to accelerate electrons emitted from the cathode 6, as will be explained later.

Near its upstream end, the sleeve 4 opens into a disk-shaped choke cavity 7 that surrounds the cathode tube 2. The choke cavity 7 is disposed at a distance from the cathode 6 equal to one quarter of the wavelength (denoted by the Greek letter lambda ($\lambda$) in the drawings) of the accelerating microwave radiation. The choke cavity 7 is oriented perpendicularly to the cathode tube 2 and extends outward from it by a distance also equal to one quarter-wavelength.

At its upstream end, which is also the upstream end of the accelerating tube 3, the sleeve 4 opens into a separate room accommodating parts connected to the cathode tube 2 (such as an insulating block 22 and terminal bolts 23 (FIG. 3) to be described later). This room is also connected to an evacuating pump (not shown) for evacuating air from the cavities in the accelerating tube 3.

During operation, the cathode 6 is heated and emits electrons to which an initial acceleration is imparted by microwave energy in the electron-gun cavity 1, creating an electron beam 5. The heating of the cathode 6 and the initial acceleration of the electrons will be described in greater detail later in relation to the second and third aspects of the invention.

Some of the accelerating microwave radiation in the electron-gun cavity 1 enters the gap between the cathode tube 2 and the sleeve 4. After traveling one quarter-wavelength down the gap between the cathode 2 and the sleeve 4, however, this microwave radiation encounters the quarter-wavelength choke cavity 7, and is thereby choked off, thus preventing the loss of microwave energy.

The choking mechanism is well known, being employed in the choke couplings of microwave waveguides, for example, and can be described as follows. The gap between the cathode tube 2 and the sleeve 4 forms a waveguide with an electrical length of one quarter-wavelength, at the end of which choke cavity 7 forms a quarter-wavelength circuit that is shorted at its far end. From the entrance opening 1*a* in the electron-gun cavity 1, therefore, the microwaves that enter the gap between the cathode tube 2 and the sleeve 4 appear to enter directly into a short circuit with an electrical length of one-half wavelength. This is equivalent to a barrier at the location of the entrance opening 1*a*, choking off the escape of microwave energy. The effectiveness of the choking action is enhanced by the small size of the gap between the cathode tube 2 and the sleeve 4, resulting in low impedance, and the much greater size of the choking cavity 7, resulting in high impedance.

Figure 2:
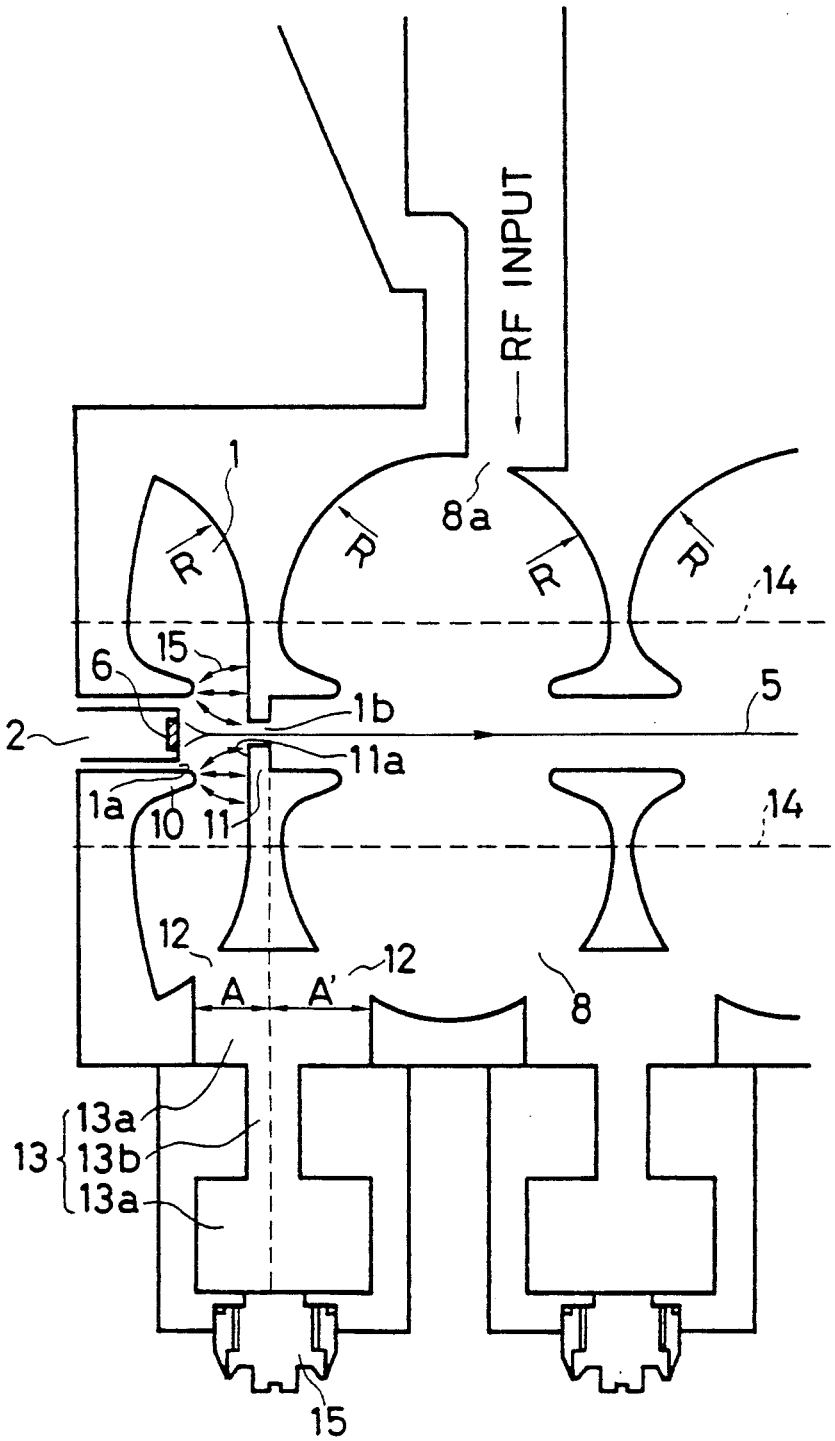
FIG. 2 is a sectional drawing illustrating a structure of the electron-gun cavity of an embodiment of the invention.

FIG. 2 illustrates a second aspect of the novel microwave electron gun, showing a more detailed structure of the electron-gun cavity 1.

The wall of the electron-gun cavity 1 comprises a protruding part 10 surrounding the entrance opening 1*a* in which the cathode 6 is disposed, and a partition 11 having a flat part 11*a* surrounding the opposite exit opening 1*b*. Outside the flat part 11*a*, the inner walls of the downstream side of the electron-gun cavity 1 have a radius of curvature equal to the radius of curvature of the walls of the other, downstream cavities of the accelerating tube 3. The centers of curvature of these walls are furthermore all disposed at the same distance from the axis of the accelerating tube 3, that is, from the electron beam 5.

Coupling openings 12 are disposed at certain locations in these curved inner walls leading from the electron-gun cavity 1 into a side cavity 13, and from the side cavity 13 into the next cavity 8 of the accelerating tube 3. The coupling openings 12 are formed where the walls of the electron-gun cavity 1 and the next cavity of the accelerating tube 3 intersect the walls of the side cavity 13.

The centers of curvature of the downstream wall of the electron-gun cavity 1 and the downstream cavities of the accelerating tube 3 are aligned. In FIG. 2, the centers of curvature lie on a cylinder represented by the pair of lines 14.

During operation, microwave radiation is introduced into the accelerating tube 3 from an opening 8*a* at the top of the cavity 8 as shown in FIG. 2. Passing through the coupling openings 12 and the side cavity 13, part of the microwave radiation enters the electron-gun cavity 1, causing a microwave electric field 15 to form between the protruding part 10 of the upstream wall of the electron-gun cavity 1 and the flat part 11*a* of its downstream wall 11, as indicated by arrows in FIG. 2. This field imparts an initial acceleration to the electrons emitted from the cathode 6.

When the phase of the microwave electric field 15 is from 0° to 180°, the field points from the protruding part 10 toward the flat part 11*a* and the acceleration is positive. When the phase of the microwave electric field 15 is from 180° to 360°, however, the field points from the flat part 11*a* toward the protruding part 10 and the acceleration is negative, causing the electron beam 5 first to decelerate, then to accelerate back toward the cathode 6. Alternatively, the decelerating field may prevent the electrons from leaving the cathode 6 at all.

Electrons emitted from the cathode 6 near the peak accelerating phase of the microwave electric field 15 gain enough energy to cross the electron-gun cavity 1 to the exit opening 1*b*, from which they pass into the accelerating cavity 8 and are accelerated to successively higher energies in the downstream cavities. Electrons emitted in other phases either fail to leave the cathode 6, or lose their energy before reaching the exit opening 1*b* and are accelerated back toward the cathode 6 in the decelerating phase.

The microwave electric field 15 formed in the electron-gun cavity 1 is a converging field that confines the electron beam 5 and directs it toward the exit opening 1*b*. In order to create a converging field, the protruding part 10 must be larger in diameter than the exit opening 1*b* in the partition 11.

The side cavity 13 has the form of a vertical, disk-shaped hollow that is narrow at the central part 13*b* and wide at the rim 13*a*, the width at the rim 13*a* being equal to A+A' in FIG. 2. The dimensions A and A' are equal. These two dimensions determine the size of the coupling openings 12: if A and A' are increased, the coupling openings 12 are enlarged; if A and A' are decreased, the coupling openings 12 are reduced in size. The size of the coupling openings in turn determines the amount of microwave power entering the electron-gun cavity 1.

Since the walls of the accelerating tube 3 and the electron-gun cavity 1 have the same radius of curvature R and their centers of curvature are aligned along the lines 14, the size of the coupling openings 12 can be varied to obtain the desired microwave power in the electron-gun cavity 1 simply by changing the dimensions A and A', without changing other dimensions. This feature of the novel microwave electron gun simplifies its design.

The volume of the side cavity 13 is another important design parameter. The side cavity 13 is provided with a bolt 15 which can be screwed in or out to adjust the cavity volume.

Figure 3:
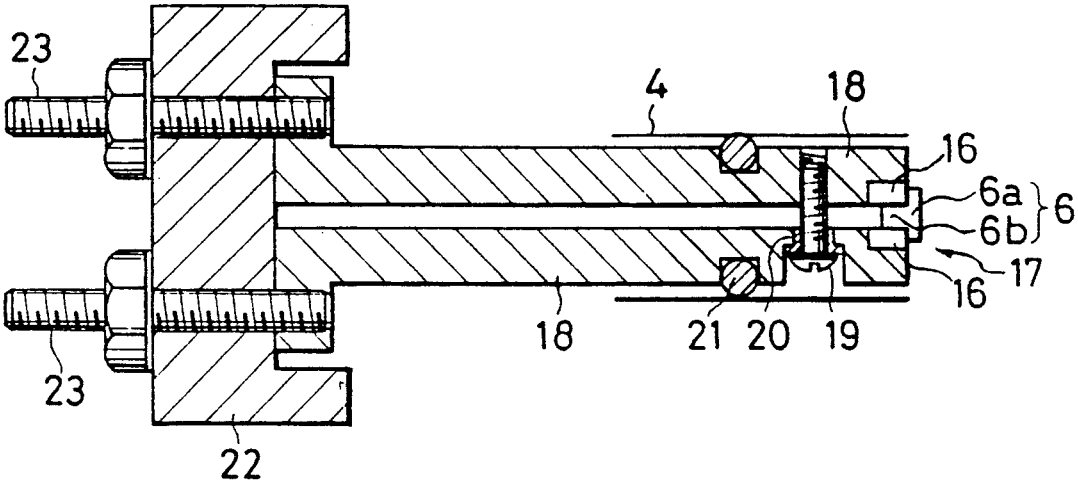
FIG. 3 is a sectional drawing illustrating a structure of the cathode tube of an embodiment of the invention.

FIG. 3 is a sectional drawing illustrating a third aspect of a invention, showing the detailed structure of the cathode tube 2 and the cathode 6. The cathode 6 is made of lanthanum hexaboride ($LaB_6$), and is enlarged at the electron-emitting end 6*a*. The rear part 6*b* of the cathode 6 behind the electron-emitting end 6*a* is fused to a pair of carbon electrodes 16 which also serve as a cathode heater. The cathode 6 and the carbon electrodes 16 form an integral structure referred to as a cathode block 17. The cathode block 17 is held clamped between a pair of semi-cylindrical electrode bars 18, clamping force being maintained by a bolt 19 that is inserted through one electrode bar 18 and screwed into the other. To prevent current from flowing through the bolt 19, the head end of the bolt 19 is insulated from the electrode bar 18 through which it passes by an insulating collar 20. In addition, a plurality of insulating bearings 21 are disposed in depressions in the electrode bars 18 at positions near the bolt 19. The insulating bearings 21 are substantially spherical in shape and can be made of, for example, a ceramic material.

When the cathode tube 2 is mounted in the electron gun, it is inserted in the sleeve 4 as was shown in FIG. 1. The insulating bearings 21 serve to insulate the electrode bars 18 from the walls of the sleeve 4. They also serve to position the cathode tube 2 accurately inside the sleeve 4, so that the cathode 6 is centered on the beam axis and the electrode bars 18 are separated by the correct gap from the walls of the sleeve 4.

At their other end, the electrode bars 18 are affixed to an insulating block 22, which also insulates them from the sleeve 4. The electrode bars 18 are attached to the insulating block 22 by means of terminal bolts 23, which also provide them with electric current from a power supply (not shown in the drawing).

During operation, a voltage is applied across the two terminal bolts 23, causing a flow of current through the electrode bars 18 and the carbon electrodes 16. The bolt 19, by applying pressure to the electrode bars 18 through the insulating collar 20, improves the electrical contact between the electrode bars 18 and the carbon electrodes 16. The current flow heats the carbon electrodes 16, which in turn heat the cathode 6 and cause a thermionic emission of electrons.

Figure 4:
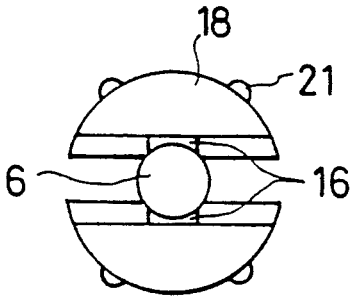
FIG. 4 is an end-on drawing showing an example of the clamping of the cathode block in the cathode tube.

FIG. 4 shows an end-on view of the cathode 6, the carbon electrodes 16, the electrode bars 18, and the insulating bearings 21, illustrating an example of the contact structure between the carbon electrodes 16 and the electrode bars 18. The contact in this example is a surface contact, which provides a good electrical coupling when the contacting surfaces of the carbon electrodes 16 and the electrode bars 18 are sufficiently flat.

Figure 5:
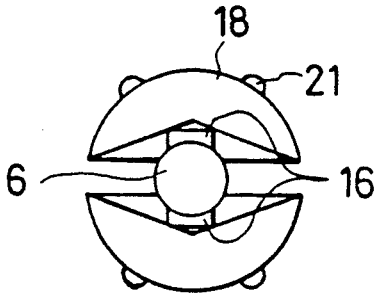
FIG. 5 is an end-on drawing showing another example of clamping of the cathode block in the cathode tube.

If the carbon electrodes 16 and the electrode bars 18 cannot be made sufficiently flat, there is a danger that a surface contact between them may be reduced to a single projecting point, allowing only a poor electrical coupling. In this case the electrode bars 18 can be structured as shown in FIG. 5, so that they contact the carbon electrodes 16 at their corners, making a pair of line contacts.

The novel electron gun structure illustrated in FIG. 3 enables the cathode 6 to be positioned close to the entrance opening 1*a* of the electron-gun cavity 1, so that the electrons emitted by the cathode 6 can be accelerated directly by microwave radiation in the cavity. The advantage is that no dc voltage is required to impart an initial acceleration to the electrons. The structure illustrated in FIG. 3 also enables the cathode tube of the electron gun to be easily mounted and accurately positioned.

The structure of the electron-gun cavity 1 illustrated in FIG. 2 provides a microwave field that also acts as a converging field, so that no Wehnelt electrode is required to force the electrons to converge into a beam. In addition, the structure is easy to design, in that the microwave power in the electron gun cavity 1 can be adjusted simply by varying the dimensions labeled A and A' in FIG. 2.

The structure of the cathode tube 2, the sleeve 4, and the choke cavity 7 illustrated in FIG. 1 provides a half-wavelength circuit that prevents the loss of microwave energy from the novel electron gun. The low impedance at the entrance opening 1*a* and the high impedance provided by the large choke cavity 7 enhance this effect.

The scope of this invention is not restricted to the structures shown in the drawings, but includes various modifications and variations that will be apparent to one skilled in the art. In particular, although the three aspects of this invention have been described in relation to a single electron gun, it will be apparent that each aspect can be employed separately. For example, the choke cavity illustrated in FIG. 1 can be applied even in an electron gun that uses a dc voltage for initial acceleration, in which case the distance from the anode hole to the choke cavity should be one quarter-wavelength.

What is claimed is:

1. A microwave electron gun for generating an electron beam to be accelerated by a microwave electric field in an accelerating tube having a series of cavities, comprising:

an electron-gun cavity for initially accelerating an electron beam, said electron-gun cavity being the first of the series of cavities in the accelerating tube, an upstream wall of which comprises a protruding part surrounding an entrance opening and a downstream wall of which comprises a flat part surrounding an exit opening for forming a converging microwave electric field therebetween; and a cathode, disposed in the entrance opening of said electron-gun cavity, for emitting the electron beam into said electron-gun cavity, microwave radiation being transmitted into said electron-gun cavity from a downstream one of said series of cavities to generate said converging microwave electric field which confines and directs the electron beam from the entrance opening to the exit opening.

2. The microwave electron gun according to claim 1, wherein the portion of the downstream wall of said electron-gun cavity other than said flat part has a radius of curvature equal to a radius of curvature of walls of the other of the series of cavities of the accelerating tube.

3. The microwave electron gun according to claim 2, wherein a center of curvature of said portion of the downstream wall of said electron-gun cavity other than said flat part is aligned with a center of curvature of the other of the series of cavities of the accelerating tube.

4. The microwave electron gun of claim 1, wherein said protruding part has a diameter which is greater than a diameter of the exit opening.

5. A microwave electron gun for generating an electron beam to be accelerated by interaction with accelerating microwave radiation in a series of accelerating cavities in an accelerating tube, comprising:

an electron gun cavity, for imparting initial acceleration to the electron beam, disposed at a first end of the accelerating tube, said electron gun cavity having a downstream wall with a flat portion surrounding an exit opening leading to the other of the series of the accelerating cavities and an upstream wall with a protruding portion surrounding an entrance opening disposed opposite said exit opening;

sleeve means disposed within said entrance opening and extending outward away from said electron gun cavity;

cathode tube means, disposed within said sleeve means and separated from an inner sleeve wall of said sleeve means by a gap;

a cathode, mounted within said cathode tube means near said entrance opening, for emitting the electron beam into said electron gun cavity; and microwave generating means, coupled to downstream one of the series of accelerating cavities, for transmitting microwave radiation into said electron gun cavity to form a converging microwave electric field between said protruding portion and said flat portion to confine and direct the electron beam from the entrance opening to the exit opening.

6. The microwave electron gun of claim 5, wherein the downstream wall of said electron-gun cavity other than said flat portion has a radius of curvature equal to a radius of curvature of walls of the other of the series of accelerating cavities of the accelerating tube.

7. The microwave electron gun of claim 6, wherein a center of curvature of the downstream wall of said electron-gun cavity other than said flat portion is aligned with a center of curvature of the other of the series of cavities of the accelerating tube.

8. The microwave electron gun of claim 5, further comprising a side cavity, connected between peripheral portions of said electron gun cavity and a first of a downstream one of the series of accelerating cavities through coupling openings, for coupling the microwave radiation from said microwave generating means into said electron gun cavity.

9. The microwave electron gun of claim 8, said side cavity being a vertical, disk-shaped hollow with bolt means mounted thereon for changing a volume of said side cavity.

10. The microwave electron gun of claim 5, wherein said protruding portion has a diameter which is greater than a diameter of the exit opening.

11. A method of generating an electron beam in a microwave electron gun having a series of accelerating cavities disposed after an electron gun cavity, comprising the steps of:

forming a flat portion of the electron gun cavity to surround an exit opening of a downstream wall of the electron gun cavity, the exit opening leading to the series of accelerating cavities;

forming a protruding portion of the electron gun cavity to surround an entrance opening of an upstream wall of the electron gun cavity;

generating and transmitting an electron beam into the electron gun cavity, using a cathode mounted within cathode tube means inside the entrance opening; and generating and transmitting microwave radiation into the electron gun cavity through a first of the series of accelerating cavities, using a microwave generating means, to form a converging microwave electric field between the protruding portion and the flat portion to confine and direct the electron beam from the entrance opening to the exit opening.

* * * * *